United States Patent [19]

Magid

[11] Patent Number: 5,065,553

[45] Date of Patent: Nov. 19, 1991

[54] ROOF FLASHING UNIT

[76] Inventor: Sanford J. Magid, 3 Blind Brook Ter., Rye Brook, N.Y. 10573

[21] Appl. No.: 522,094

[22] Filed: May 11, 1990

[51] Int. Cl.[5] ..... E04B 7/00; E04D 1/28

[52] U.S. Cl. ..... 52/58; 52/60; 52/96; 52/409; 52/528; 52/529

[58] Field of Search ..... 52/57, 58, 96, 528, 52/529, 530, 59, 94, 60, 408, 409, 410, 543

[56] References Cited

U.S. PATENT DOCUMENTS

| | | | |
|---|---|---|---|
| 1,218,937 | 3/1917 | Heard | 52/60 |
| 4,071,987 | 2/1978 | Hickman | 52/94 |
| 4,601,135 | 7/1986 | Ellis et al. | 52/58 |

*Primary Examiner*—David A. Scherbel
*Assistant Examiner*—Deborah M. Ripley
*Attorney, Agent, or Firm*—Michael Ebert

[57] ABSTRACT

A roof flashing unit which is attachable to a parapet or other upstanding wall at its intersection with a roof to ensure a tight, waterproof roof construction. The unit includes a rectangular sheet of bendable metal having a transverse Z-shaped bend therein to define an upper or counter section which is secured to the wall and a larger base section. The diagonal of the Z bend forms with the counter section are open-ended channel, and it forms with the base section an open-ended pocket. Wedged into the pocket is the upper edge of a flexible waterproof membrane which overlies the base section. To arrange the flashing units in an overlapping series, the fold line between the diagonal and base sections at the end of one unit in the series is slit to permit telescoping of the channel of the adjacent unit into the channel of the one unit, the base section of the adjacent unit overlapping the base section of the one unit and the membrane of the adjacent unit overlapping the membrane of the one unit, whereby the membranes are shingled.

11 Claims, 2 Drawing Sheets

ROOF FLASHING UNIT

BACKGROUND OF INVENTION

1. Field of Invention:

This invention relates generally to roof flashings to ensure a tight roof construction, and more particularly to a flashing unit which is adapted to be marginally telescoped into a like unit whereby a series of such units in overlapping relation may be installed on an upstanding wall at its intersection with the roof.

2. Status of Prior Art:

The purpose of roof flashing, which is installed at the intersection of a roof and a parapet, curb or other upstanding wall is to ensure a tight roof construction, for in the absence of flashing, water may leak into the junction between the roof and the wall. In order to render a roof watertight, a common practice is to use roofing felt whose end is turned up to bear against the face of the upstanding wall, a metal flashing of copper or other material being then applied to occupy the angle between the roof and the wall.

In the Hobbs U.S. Pat. No. 1,992,123, the metal flashing includes an upwardly extending flange section covering the upturned end of the roof felt which bears against the wall, and an outwardly extending base section which covers the portion of the roofing felt applied to the roof. Between the flange and the base section of the metal flashing is a sealing strip created by a fold in the metal to form a pocket between it and the base section of the flashing. Inserted in this pocket is the edge of a sheet of roofing material. The practical drawback to the Hobbs arrangement is that while the flashings can be installed in edge to edge relation to form a longitudinal series of flashings along the wall, the flashings are not watertight at their abutting edges. Moreover, it is not watertight along corners unless special fittings are provided, or the metal flashings are soldered together at their edges, which is, a costly and time consuming procedure.

The Wilson U.S. Pat. No. 2,057,285, discloses a metal flashing which may be nailed onto a concrete wall and which includes a trough adapted to receive a plastic sealing material. This flashing is not easily workable around corners.

The Griffiths U.S. Pat. No. 1,105,422, discloses a metal counter flashing which is bent upon itself to provide a wing and a holding loop, a canvas base flashing being pinched between the loop and the wing. A flashing which combines metal and textile components is impractical and expensive under current conditions, and doesn't lend itself readily to the longitudinal interconnection of flashings.

The Theriault U.S. Pat. No. 3,698,143, discloses a flashing sheet bent into a V-shape for disposition on a shingle and against the side to be flashed, the sheet having a portion that is inserted under the top edge of the shingle. This is essentially a base flashing and requires an excessive amount of labor to install.

SUMMARY OF INVENTION

The main object of this invention is to provide a highly effective roof flashing unit which is attachable to a parapet or other upstanding wall at its intersection with a roof to ensure a tight, waterproof roof construction.

More particularly, an object of this invention is to provide a unit of the above type which is easily installed and which may be mass produced at low cost.

A significant feature of the invention is that each flashing unit may be marginally joined to an adjacent unit, making it possible to install a longitudinal series of overlapping units which are not subject to water leakage at the joints between the units.

Also an object of the invention is to provide a unit of the above type which is readily bendable to conform to a wall corner.

Briefly stated, these objects are attained in a roof flashing unit which is attachable to a parapet or other upstanding wall at its intersection with a roof to ensure a tight, waterproof roof construction. The unit includes a rectangular sheet of bendable metal having a transverse Z-shaped bend therein to define an upper or counter section which is secured to the wall and a larger base section.

The diagonal of the Z bend forms with the counter section an open-ended channel, and it forms with the base section an open-ended pocket. Wedged into the pocket is the upper edge of a flexible waterproof membrane which overlies the base section. To arrange the flashing units in an overlapping series, the fold line between the diagonal and base sections at the end of one unit in the series is slit to permit telescoping of the channel of the adjacent unit into the channel of the one unit, the base section of the adjacent unit overlapping the base section of one unit and the membrane of the adjacent unit overlapping the membrane of the one unit whereby the membranes are shingled.

BRIEF DESCRIPTION OF DRAWINGS

For a better understanding of the invention as well as other objects and further features thereof, reference is made to the following detailed description to be read in conjunction with the accompanying drawings, wherein.

DETAILED DESCRIPTION OF INVENTION

Figure 1:
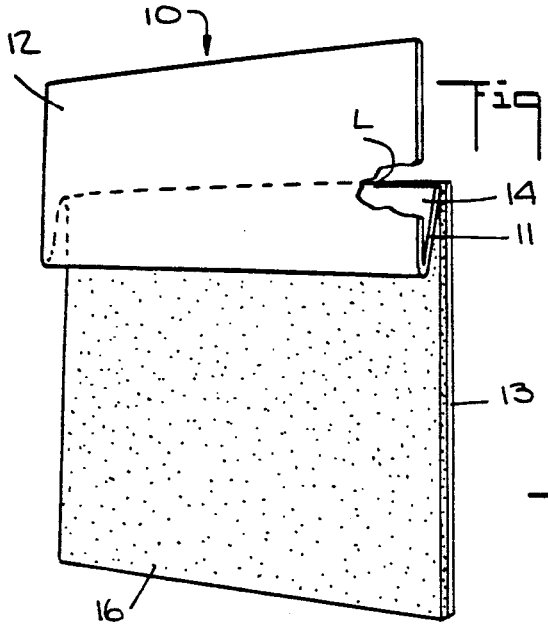
FIG. 1 is a perspective view of a flashing unit in accordance with the invention.

First Embodiment:

Referring now to FIGS. 1, 2, 2A and 3, there is shown a flashing unit in accordance with the invention, the unit including a generally rectangular metal sheet 10. Sheet 10 is fabricated of galvanized iron, copper, aluminum, stainless steel or any other bendable metal suitable for flashing and capable of withstanding the climatic conditions to which flashing is subjected.

Sheet 10 is provided with a Z-shaped transverse bend that includes a diagonal 11, the bend dividing the sheet into an upper or counter section 12 and a larger base section 13. Diagonal 11, as best seen in FIG. 2A, defines with counter section 12, which is joined to the lower end thereof, an open-ended channel 14. And it defines with base section 13, which is joined to the upper end of the diagonal, an open-ended pocket 15. The channel and the pocket have opposed V-shaped configurations.

Wedged into pocket 15 is the upper edge of a rectangular membrane 16 whose dimensions substantially correspond to those of base section 13, so that the membrane overlies this section. Membrane 16 is formed of flexible, heavy-duty, waterproof material, such as a rubberized fabric, modified bitumen material (APP or SBS),PVC roofing material,EPDM, or other roofing material capable of withstanding the climatic conditions encountered on a roof. Membrane 16 is bonded, as by an epoxy or other adhesive agent, to base section 13 at least in the region of pocket 15 so that it cannot be dislodged therefrom.

Figure 4:
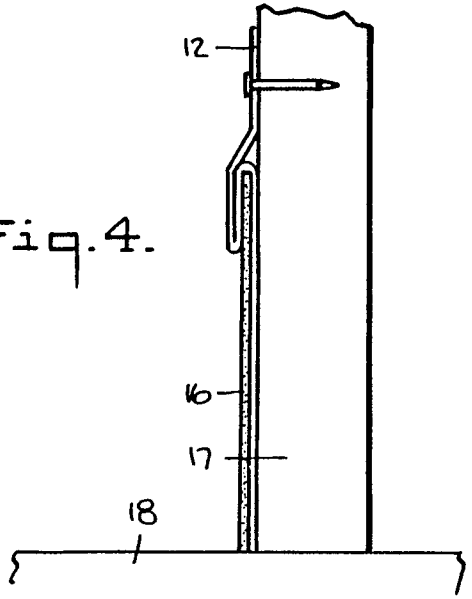
FIG. 4 shows the unit attached to a wall.

When, as shown in FIG. 4, the flashing unit is attached to an upstanding wall 17 at its intersection with a roof 18, the counter section is attached by screws, nails, staples, masonry anchors or other fasteners, depending on the nature of the wall material, to wall 17. In practice, the base section of the flashing unit may also be attached to the wall. These fasteners are applied at sites that are displaced from the side edges of the unit, for the units, as will be explained later, are marginally telescoped together in overlapping series. But after the units are installed in telescoping relation, additional fasteners may be applied to ensure a secure and permanent attachment.

Figure 5:
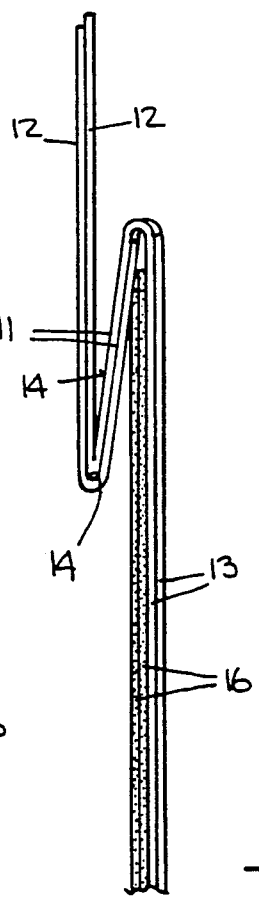
FIG. 5 is a side view showing one unit marginally telescoped within another, whereby the membranes thereof are in overlapping relation.
Figure 3:
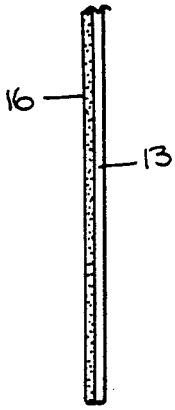
FIG. 3 is a separate view of the membrane included in the unit.
Figure 3:
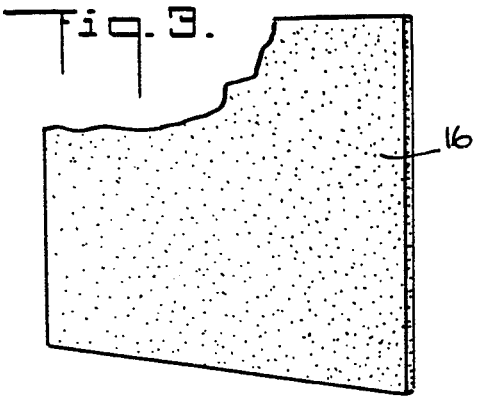
Figure 6:
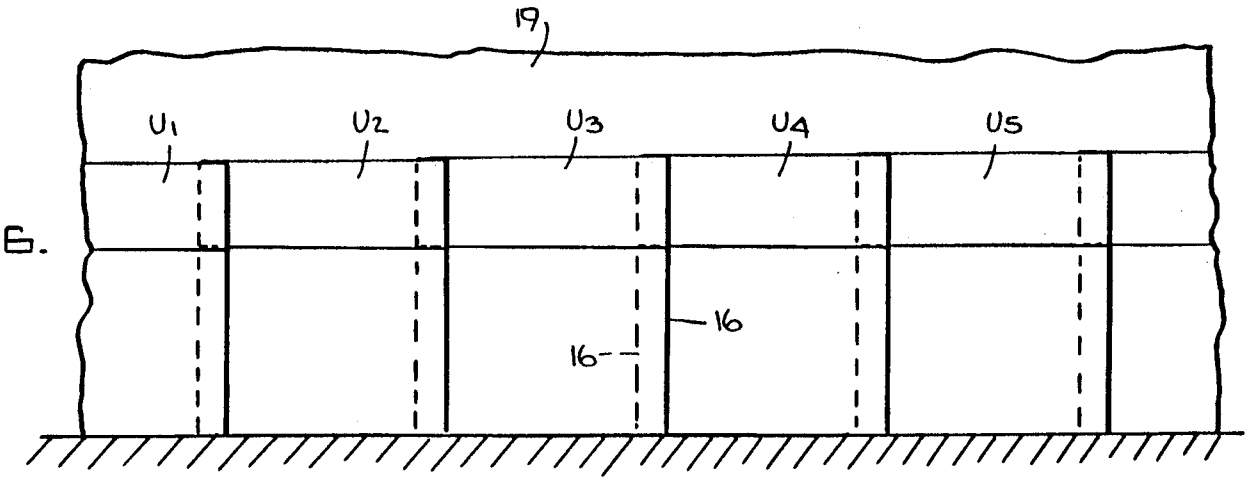
FIG. 6 shows a series of units which are marginally joined together and are attached to a wall.

To interconnect like units in an overlapping series, the fold line L between diagonal 14 and base section 13 on one unit is slit at the end to be overlapped, say, two inches in, to the extent necessary to provide the desired degree of overlap. Then, as shown in FIG. 5, the channel 14 of the adjacent unit in the series is telescoped in the channel 14 of the first unit, the base section 13 of the adjacent unit overlapping the base section of the first unit and the membrane of the adjacent unit overlapping the membrane of the first unit, whereby the membranes in the series are then shingled. The overlapped zones of the base sections are preferably caulked. Thus one can install on wall 19, as shown in FIG. 6, a series of marginally intertelescoping flashing units $U_1$, $U_2$, $U_3$, etc.

In practice, after the flashing units are installed on a wall so that the lower edge of membrane 16 abuts or is very close to the roof at its intersection with the wall, then a bead of caulking of silicone or similar material may be applied to this intersection to render it watertight. One may also apply a silicone coating on the face of the flashing unit.

Figure 7:
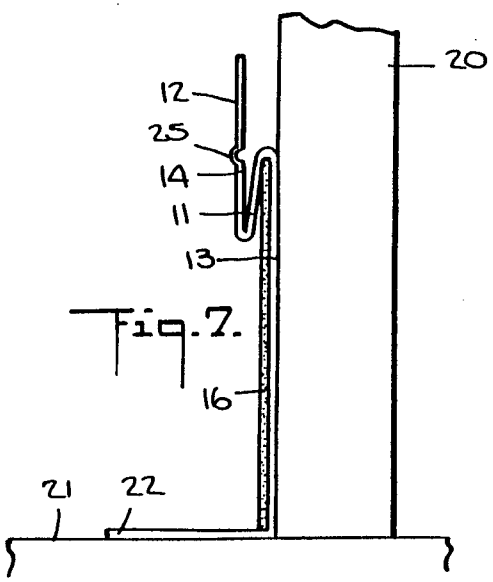
FIG. 7 shows, in side view a modified unit having a flange section.

Second Embodiment:

The flashing unit shown in FIG. 7, which is installed against a wall 20 at its intersection with a roof 21, has in addition to a counter section 12 and a base section 13, a bent out flange section 22 at right angles to the base section.

All sections of the flashing unit, including the transverse Z-bend therein, are formed of the same metal sheet. But in this instance, the junction angle formed by wall 20 and roof 21 is covered by flange section 22 and base section 13 of the flashing, and flange section 22 is fastened to the roof. The lower edge of membrane 16 is joined and sealed to the roofing as per the manufacturer's specification. A cant strip may be placed at the junction of flange section 22 and base section 18, the membrane going over the cant.

In practice, counter section 12 may be provided with a reglet, that is, a narrow, inwardly directed trough that is receivable in a corresponding horizontal groove formed in the wall. The reglet is filled with caulking and serves to maintain the flashing at its proper position on the wall. And counter section 12 may also be provided with a transverse bead or convex projection 25, which when the units are telescoped, the bead of one lies within the bead of the other to maintain the units in alignment.

Figure 8:
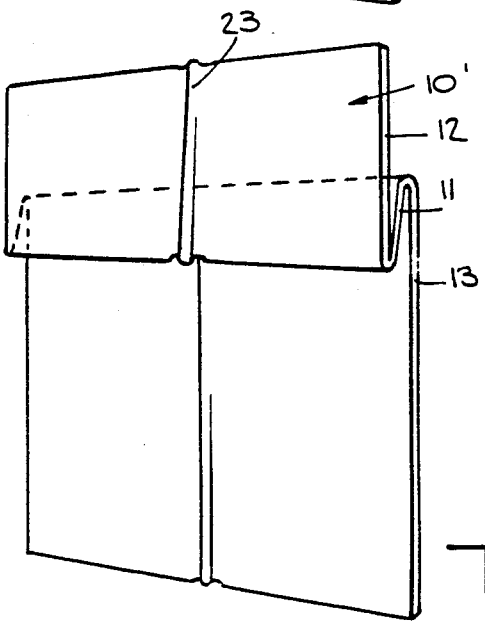
FIG. 8 is a perspective view of a modified unit which is corrugated so that it can be folded to conform to a corner or other angled surface.

Third Embodiment:

The flashing unit shown in FIG. 8 includes a membrane, but this membrane is omitted to show only the metal flashing sheet 10' This sheet is the same as metal sheet 10 in FIG. 1, except that in this instance a longitudinal band of corrugations 23 is formed along the center axis of the unit, making it possible to fold the unit to assume any desired angle.

Figure 9:
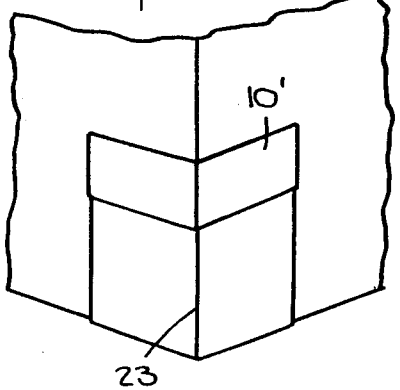
FIG. 9 shows the corrugated unit attached to a corner.

Thus as shown in FIG. 9, when the unit which includes flashing 10' is to be attached to the sides of a corner 24, the unit is bent to conform to the corner angle, the band of corrugations 23 being then aligned with the edge of the corner. One can, of course, marginally telescope an uncorrugated unit to one side of the corrugated unit and another uncorrugated unit to the other side.

Modifications:

In practice, instead of a single longitudinal band of corrugations as shown in FIG. 8, the entire metal flashing sheet 10' may be uniformly corrugated along its entire surface so that the flashing may be folded at any desired zone to cover an angled surface, or it may be contoured to cover a curved surface.

Figure 2:
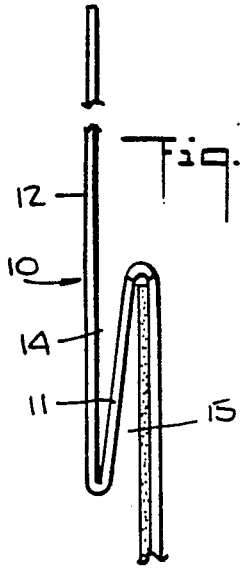
FIG. 2 is a side view of the unit.
Figure 2A:
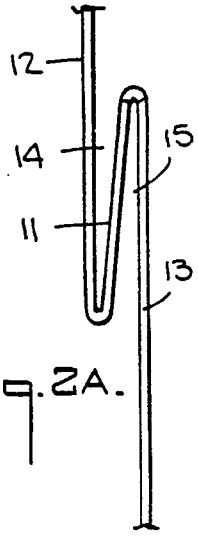
FIG. 2A is a separately shows the bend in the flashing.

In the flashing unit shown in FIG. 2, the planar counter section 12 forms a channel 14 with diagonal 11, the channel having a V-shaped cross section. In practice, this V formation may be bent out somewhat at the midline of diagonal 14 to create an enlarged entry into pocket 15.

This enlarged entry makes it possible when a roof is to be recovered at some future time for an installer to insert into this pocket the upper edge of a secondary membrane to overlie the flashing membrane 16 already in place, the new roof being joined to the secondary membrane.

While there have been shown and described preferred embodiments of a roof flashing unit in accordance with the invention, it will be appreciated that many changes and modifications may be made therein, without, however, departing from the essential spirit thereof.

I claim:

1. A flashing unit for installation on an upstanding wall at its intersection with a roof, said unit comprising:

(a) a rectangular metal flashing sheet having a transverse bend therein dividing the sheet into an upper counter section attachable to the wall and a large base section that extends to the roof, said bend having a Z-formation whose diagonal defines with the counter section an open-ended channel and the base section an open-ended pocket; and (b) a flexible, waterproofing rectangular membrane whose upper edge is received in said pocket, the membrane overlying the base section and having a length that extends substantially to the roof, whereby said membrane is substantially coextensive with said base section, said flashing unit being one unit in an overlapping series of like units, the fold line between the diagonal and the base section at the end of said one unit in the series being slit to permit telescoping of the channel of the adjacent unit in the channel of the one unit, the base section of the adjacent unit overlapping that of the one unit and the membrane of the adjacent unit overlapping that of the one unit whereby the membranes are shingled.

2. A unit as set forth in claim 1, wherein said sheet is made of metal selected from the group consisting of galvanized iron, copper, stainless steel and aluminum.

3. A unit as set forth in claim 1, wherein said membrane is formed of modified bitumen.

4. A unit as set forth in claim 1, wherein said sheet includes a flange section joined to the lower edge of the base section and extending at an angle thereto to overlie said roof.

5. A unit as set forth in claim 1, wherein said membrane is bonded to the base section at least in the region of said pocket so that it cannot be dislodged therefrom.

6. A unit as set forth in claim 1, wherein said counter section has a reglet formed therein.

7. A unit as set forth in claim 1, wherein said sheet has a longitudinal band of corrugations extending along the midpoint thereof whereby the unit is foldable.

8. A unit as set forth in claim 1, wherein the entire sheet is provided with a uniform array of corrugations to permit bending thereof.

9. A flashing unit as set forth in claim 1, further including a bend of sealing material applied to the intersection of the membrane and the roof to render it water tight.

10. A flashing unit as set forth in claim 1, wherein said membrane is formed of rubberized fabric.

11. A flashing unit as set forth in claim 1, wherein said membrane is formed of polyvinyl chloride roofing material.

* * * * *